US010750888B2

(12) United States Patent
Watson

(10) Patent No.: US 10,750,888 B2
(45) Date of Patent: Aug. 25, 2020

(54) IN-SITU SURFACE MARKER FOR SURFACE HANGINGS

(71) Applicant: Amy M. Watson, Vinalhaven, ME (US)

(72) Inventor: Amy M. Watson, Vinalhaven, ME (US)

( * ) Notice: Subject to any disclaimer, the term of this patent is extended or adjusted under 35 U.S.C. 154(b) by 226 days.

(21) Appl. No.: 15/988,102

(22) Filed: May 24, 2018

(65) Prior Publication Data

US 2019/0357706 A1 Nov. 28, 2019

(51) Int. Cl.
*A47G 1/20* (2006.01)
*B25H 7/04* (2006.01)

(52) U.S. Cl.
CPC ..... *A47G 1/205* (2013.01); *B25H 7/04* (2013.01)

(58) Field of Classification Search
CPC ..... A47G 1/205
USPC ..... 33/613, 666
See application file for complete search history.

(56) References Cited

U.S. PATENT DOCUMENTS 4,336,884 A * 6/1982 Hart ..... A47G 1/205 206/575
4,382,337 A * 5/1983 Bendick ..... B25H 7/04 33/574
4,512,084 A 4/1985 Lieberman
5,477,620 A * 12/1995 Barnett ..... B25H 7/04 33/644
6,574,880 B2 6/2003 Lombardo
7,185,442 B2 3/2007 Grillo
7,278,223 B1 * 10/2007 Dever ..... B25H 7/04 33/574
7,958,648 B1 * 6/2011 MacConnell ..... B25H 7/045 33/613
8,615,894 B1 12/2013 Schoenebeck
8,898,945 B2 12/2014 Miller
2004/0098875 A1 * 5/2004 Gould ..... A47G 1/205 33/613
2004/0216319 A1 * 11/2004 Muchnik ..... A47G 1/205 33/666
2006/0075650 A1 * 4/2006 Tatum ..... B25H 7/045 33/666
2007/0119068 A1 * 5/2007 Horst ..... A47G 1/205 33/666
2007/0283588 A1 * 12/2007 Gardner ..... F16B 15/02 33/666
2008/0078916 A1 * 4/2008 Nevers ..... A47G 1/1606 248/475.1
2009/0193674 A1 * 8/2009 Megahed ..... A47G 1/205 33/666
2011/0174953 A1 7/2011 Ruiz et al.
(Continued)

*Primary Examiner* — Christopher W Fulton
(74) *Attorney, Agent, or Firm* — Trenner Law Firm, LLC; Mark D. Trenner

(57) ABSTRACT

A device for marking the position of surface hanging fasteners is disclosed. An example device may include a piece of material with an adhesive side that is capable of adhering to, or adhering adjacent to or in the expected position of, a piece of attachment hardware of a surface hanging such as a picture frame. The example device may also include a marking side that includes a marking material capable of leaving a mark on a surface against which it is pressed, such that when the surface hanging is held against the surface in the desired position and orientation, a mark is created on the surface in the position of the desired fastener.

19 Claims, 8 Drawing Sheets

(56) References Cited

U.S. PATENT DOCUMENTS

| | | | | |
|---|---|---|---|---|
| 2017/0021493 | A1 | 1/2017 | Subei | |
| 2019/0070877 | A1* | 3/2019 | Flores | B41K 1/003 |

* cited by examiner

IN-SITU SURFACE MARKER FOR SURFACE HANGINGS

BACKGROUND

A variety of different implements, fixtures, and decorations exist, that are hung from walls and ceilings, including frames, pictures, shelves, mirrors, shadow boxes, and other tools decorations, and fixtures (broadly referred to herein as "wall hangings" or "surface hangings"). However, the correct placement of surface hangings involves cumbersome measurements that may require more than one person, e.g., one person to hold the wall hanging while another person measures. Incorrect measurements may result in one or more unwanted markings or even nail or screw holes in the wall or ceiling.

Whether accomplished by a single individual or by two or more individuals, this process may involve many distinct steps. For example, first the desired location is located on the wall by holding the surface hanging in place. Next a first mark with a pencil or other marking instrument is made on the wall along the top and possibly also side edge of the surface hanging. Then, the location of the attachment hardware (e.g., hanging wire, recess, lip, or nail holder) on the back of the surface hanging is measured from the top and possibly side edge to locate the hardware relative to the edge of the surface hanging. That measurement is then translated to the wall and a second mark is made on the wall at the measured location for the attachment hardware the wall. Then one or more nail, screw, hook, or other fastener (referred to herein as "fasteners") may be attached to the wall so that the surface hanging can be hung on the wall.

Multiple pieces of hardware (e.g., two hangers on each side of the surface hanging) may require several measurements and pencil marks on the wall. If any of these measurements are made incorrectly, then one or more fasteners may have to be removed from and replaced into the wall several times before the surface hanging is level in the desired location. This may create unnecessary and unwanted holes in the wall.

DETAILED DESCRIPTION

Figure 1:
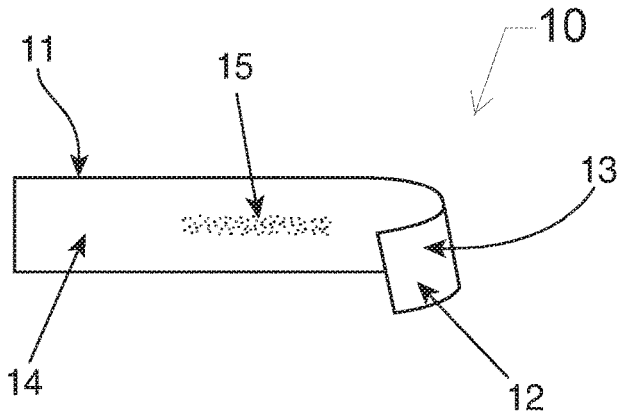
FIG. 1 shows an example in-situ surface marker.

An in-situ surface marker is disclosed as it may be implemented for surface hangings (e.g., hanging a picture on a wall). In an example, the in-situ surface marker enables the correct placement of a surface hanging in the desired location on the wall or other surface, without the cumbersome measurement process typically involved. This may aid in a single person correctly hanging their picture on a wall, without assistance from another person, in less time, in the desired position the first time, and without creating multiples holes in the wall.

In an example, the in-situ surface marker (also referred to herein as a device) includes an adhesive side that attaches to a surface hanging. The example in-situ surface marker also includes a marking side. During use, the marking side touches a wall, ceiling, or other surface to leave a visible, but easily removable, guide mark that can then be used to properly position a wall hanger such as a nail or screw or other fastener for hanging the picture or other surface hanging.

In an example, the in-situ surface marker is a strip of flexible material. The flexible material may include an adhesive layer on one side for temporary attachment to the hardware on the surface hanging. The flexible material may also include a marking material (e.g., chalk, wax, or graphite) on the other side. The marking material may be shaped as a simple dot or line segment, or may be in the shape of one or more circles, triangles, rectangles, or other shape(s) that correspond to the shapes of attachment hardware included on the surface hanging. As such, the in-situ surface marker can be implemented with any of a wide variety of surface hangings hanging any implementation for hanging the surface hanging on a wall, such as but not limited to, one or more nails, screws, hooks, etc. (any of which may be referred to herein as a fastener or fasteners).

In an example, a user of the device presses the adhesive side of the in-situ surface marker against the wall-facing or ceiling-facing side of the surface hanging. The adhesive may be positioned directly on, or adjacent to, the attachment hardware for the surface hanging. Optionally additional in-situ surface markers may be provided to mark the locations of additional attachment points, edges, or other positions on the surface hanging, for translation to the wall. Having affixed the adhesive side of the in-situ surface marker on the surface hanging, the marking material is facing outward from the back of the surface hanging. The user then marks the desired location of the surface hanging on the wall or ceiling by holding the surface hanging adjacent or against the wall or other surface and gently pressing the surface hanging so that some or all of the marking material is transferred onto the wall or other surface. The marking material remains on the wall or other surface, even when the surface hanging is removed from the wall, thus leaving a marking on the wall at the desired location.

In an example, a level (e.g., a spirit level, bubble level, digital inclinometer, or accelerometer-equipped smartphone with leveling app) may be placed on top of the surface hanging during this procedure, so that the in-situ surface marker, when pressed into the wall, leaves a level marking on the wall and so as to permit the wall hanging to be hung or affixed in the desired location, orientation, and fine adjustment angle.

Because in-situ surface markers mark the exact location to insert one or more applicable fasteners on the wall or other surface, a user can employ in-situ surface markers to hang the surface hanging in a level position even if the hardware is mounted crooked or uneven on the surface hanging itself.

In an example, the user may then attach one or more fasteners to the wall in the one or more locations marked by the one or more in-situ surface markers, regardless of positioning of the hardware on the surface hanging.

After affixing the fastener on the wall or other surface (e.g., by pounding a nail, driving a screw, etc. into the wall), the user may wipe away or otherwise remove the surface marking left behind by the in-situ surface marker, if desired. The user may then hang or affix the surface hanging by connecting the hardware to the fasteners in a manner that would be typical for a surface hanging.

The in-situ surface marker is straightforward to use, and can therefore be used by nearly anyone with or without assistance, to properly locate the position on a surface behind an object such as a surface hanging. As will be readily appreciated by those having ordinary skill in the art after becoming familiar with the teachings herein, the easily removable surface markings left behind by the in-situ surface marker eliminate or greatly reduce the aforementioned difficulties with placing or affixing a surface hanging in the desired location orientation, and fine-angle tuning.

Before continuing, it is noted that as used herein, the terms "includes" and "including" mean, but is not limited to, "includes" or "including" and "includes at least" or "including at least." The term "based on" means "based on" and "based at least in part on."

FIG. 1 shows an example in-situ surface marker 10. An example of the in-situ surface marker 10 includes a base 11 with an adhesive side 12 that includes an adhesive 13, and a marking side 14 that includes a pattern of marking material 15.

In an example, the base 11 may be a flexible strip 11. For example, the base 11 may be made of cloth, paper, metal foil polymer film or tape, or any other thin, relatively conformable material that may readily be adhered to irregularly shaped surfaces.

The adhesive side 12 of the base 11 may be coated with a continuous layer of adhesive 13, or may be coated with drops, spots, stripes, or any other pattern of adhesive that may reasonably be expected to adhere the flexible strip 11 to irregular surfaces for the desired time (e.g., a period of several minutes for wall hangings).

In an example, the adhesive 13 is a removable adhesive with properties similar to the adhesives of masking tape, clear office tape, or removable sticky notes, although based on design considerations, more durable adhesives, including permanent adhesives, may also be provided, e.g., where the removal of the in-situ surface marker is not considered to be important.

In an example, the marking side 14 of the base 11 includes a pattern of marking material 15. The marking material 15 may be any suitable material, e.g., selected from dust, chalk, graphite, or other material that is easily removable, without leaving a residue or discoloration. In other examples, where the removal of the surface marking is not considered important, the marking material 15 may be selected from more durable options. Examples include, but are not limited to, ink, wax, or paint. In an example, the marking material 15 of the in-situ surface marker 10 is arranged in a zig-zag pattern, although numerous other patterns may be employed.

Before continuing, it should be noted that the examples described above are provided for purposes of illustration, and are not intended to be limiting. Other components and/or component configurations may be utilized to carry out the operations described herein.

Figure 2:
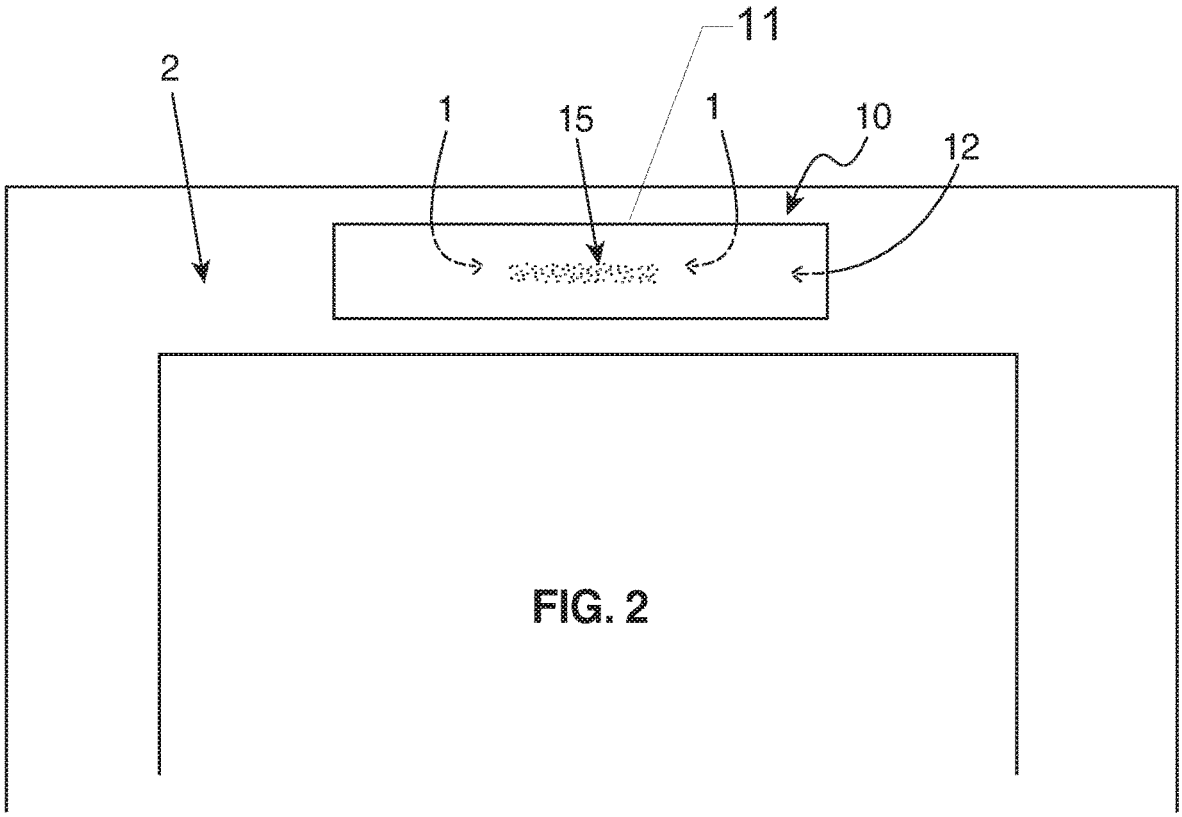
FIG. 2 shows an example in-situ surface marker temporarily affixed to the back of a surface hanging.

FIG. 2 shows an example in-situ surface marker 10 temporarily affixed to the back of a surface hanging. The example in-situ surface marker 10 is shown with the adhesive side 12 of the base 11 (as shown in FIG. 1) temporarily affixed over the attachment hardware 1 (see, e.g., FIGS. 8-10, not visible in FIG. 2) located on the back of a surface hanging 2 (in this case, a picture frame).

It is noted that the base 11 of the in-situ surface marker 10 may be attached in any desired location on the surface hanging 2. The base 11 may be positioned on or adjacent the attachment hardware 1, or in any other location, such as but not limited to, the corners, a side, etc. of the surface hanging 2. Positioning of the base 11 is to indicate a position on the back side of the surface hanging 2 for translation to another surface, such as a wall. In addition more than one in-situ surface marker 10 may be provided on the surface hanging 2.

Figure 6:
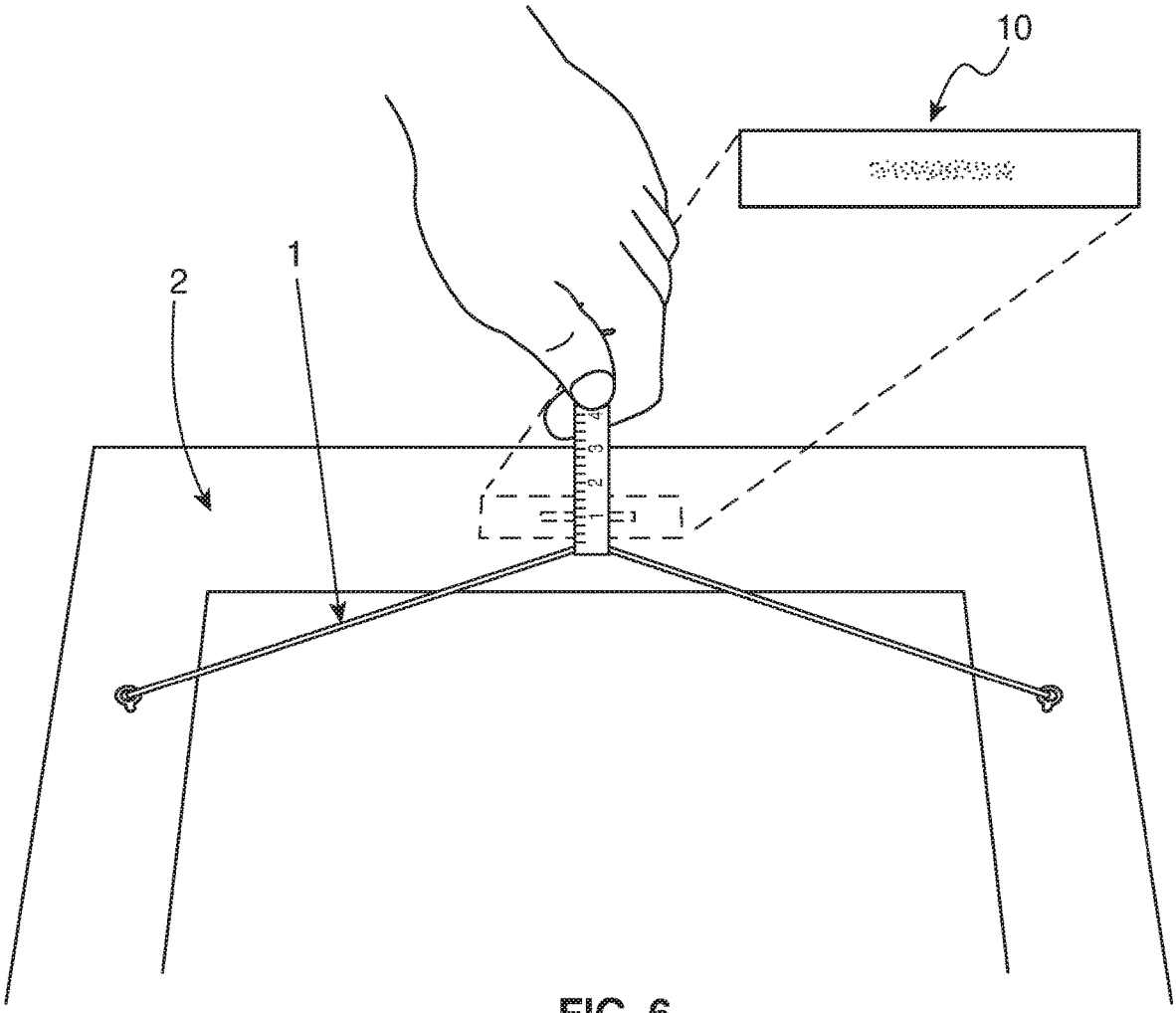
FIG. 6 shows an example process of placing an example in-situ surface marker on an example surface hanging.
Figure 7:
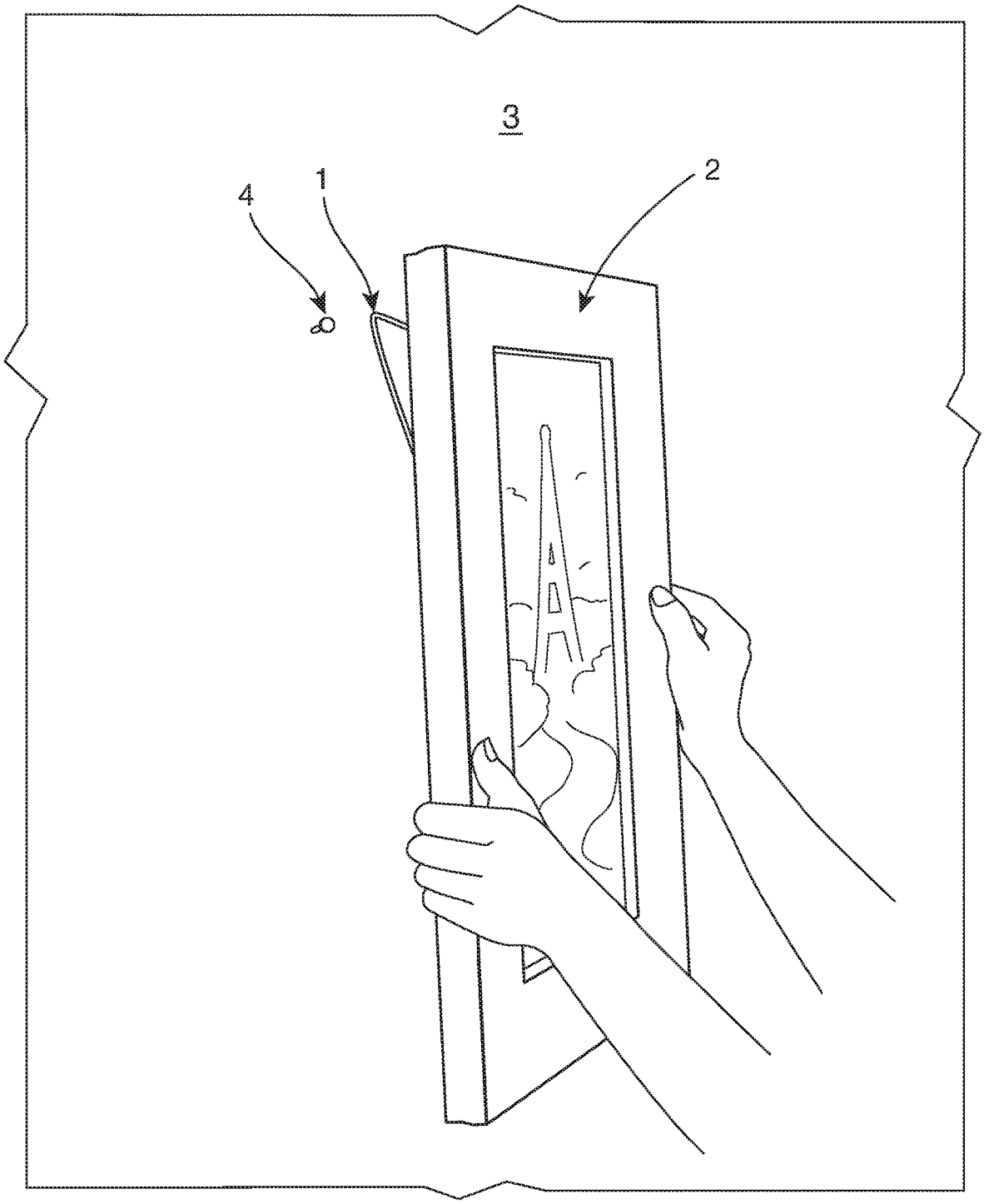
FIG. 7 shows an example surface hanging being hung on the wall having used the techniques described herein.

It is noted that in another example the in-situ surface marker 10 may be affixed to the expected position of the attachment hardware 1, as with a wire whose taut when hung from a fastener on the wall, as shown for example in FIGS. 6 and 7. As such, the in-situ surface marker aids in locating on the wall the position of the wire even though it cannot easily be maintained while the surface hanging 2 is pressed against the surface 3.

As shown in FIG. 2, when the base 11 is attached to the surface hanging 2, the marking material 15 is facing outward from the back of the surface hanging. In this example, the marking material is arranged in a stripe that corresponds to the approximate height and width of the attachment hardware 1. However, any desired size, shape, or other pattern may be provided by the marking material 15.

Figure 3:
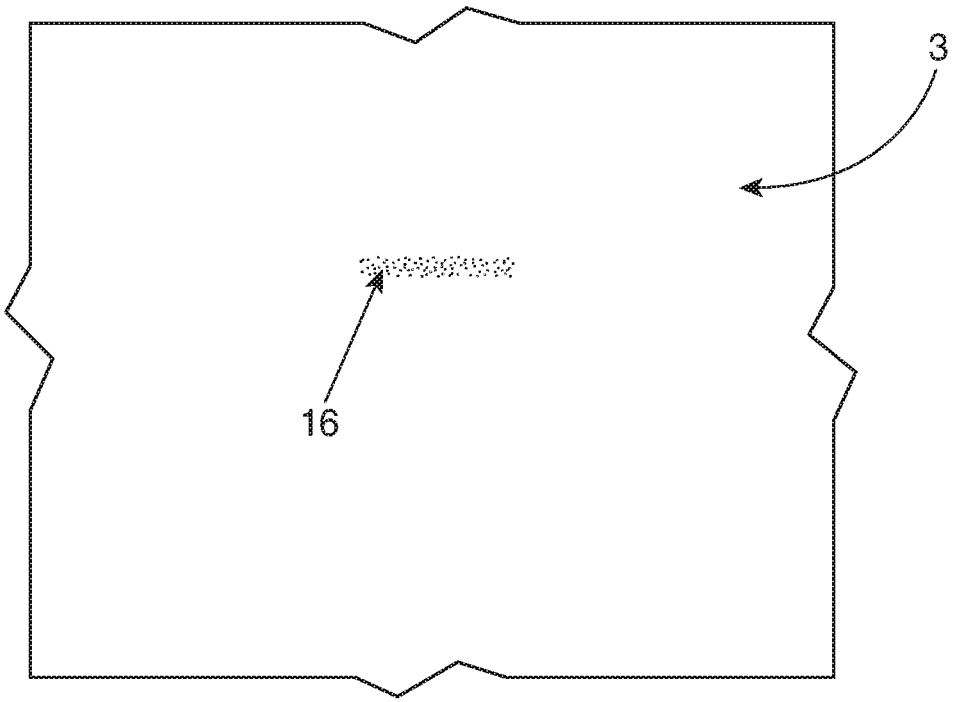
FIG. 3 shows an example surface mark made on a wall or other surface by an example surface marker on the back of a surface hanging.

FIG. 3 shows an example surface mark 16 made on a wall or other surface 3 by the marking material of the example surface marker 10 shown in FIG. 1 as it may be provided on the back of a surface hanging 2.

In an example, the surface mark 16 is easily removable from the wall 3. In other examples, based on design considerations, it may include materials that are difficult to remove, or even be permanent.

Figure 4:
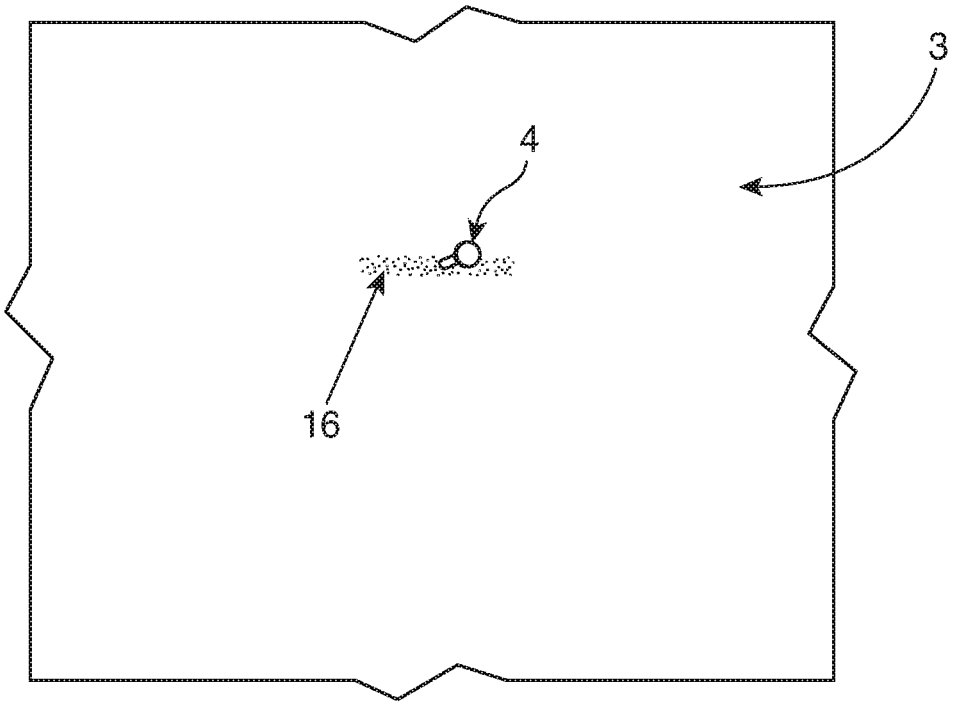
FIG. 4 shows an example fastener driven into a wall at the location where the example surface mark was shown made on the wall in FIG. 3.

FIG. 4 shows an example fastener 4 (e.g., a nail) that has been driven into a wall 3 at the location where the example surface mark 16 was made on the wall, as shown in FIG. 3. The example fastener 4 (in this case, a nail) can be driven into a wall or other surface 3 at the location of the example surface mark 16 for proper positioning on the wall without need for any measuring.

Figure 8:
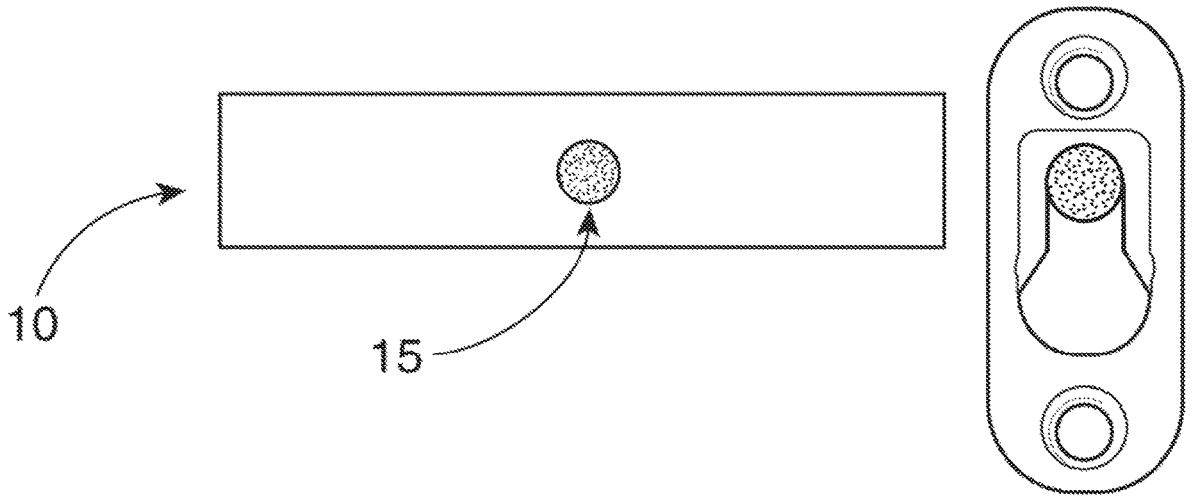
FIG. 8 shows another example of in-situ surface markers with corresponding example attachment hardware.

In the example shown in FIG. 4, a single fastener 4 has been driven into wall at the position indicated by the surface mark 16. In other examples, multiple fasteners 4 may be driven into a single surface mark 16. In another example, multiple surface marks 16 may be made by one or more device 10, e.g., corresponding to different hardware 1 on the surface hanging 2 as shown in FIG. 8.

Figure 5:
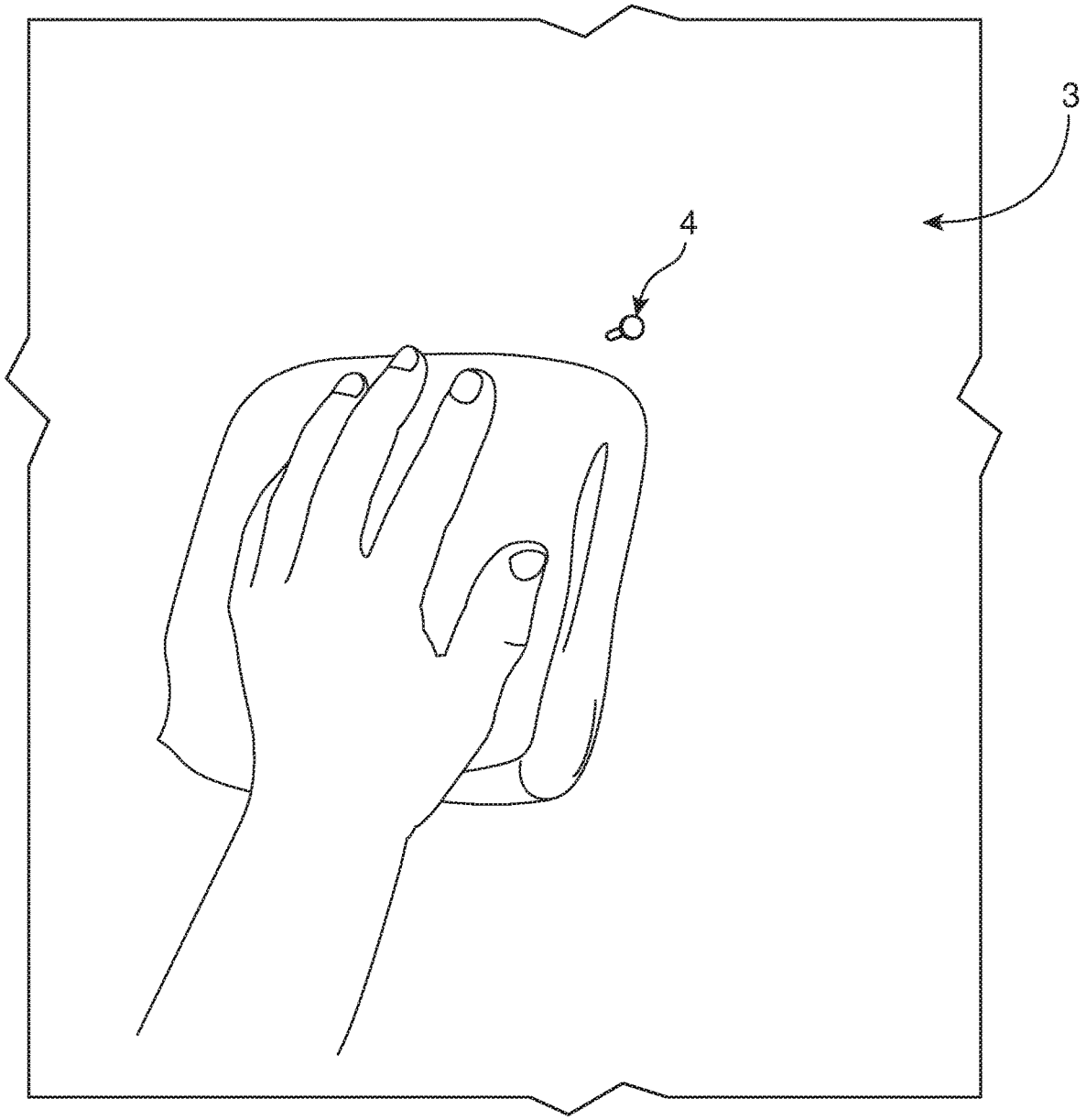
FIG. 5 shows the example fastener of FIG. 4 wherein the example surface mark of FIG. 4 has been wiped away.

FIG. 5 shows the example fastener 4 remaining in the wall, wherein the example surface mark 16 shown in FIG. 4 has been removed from the wall. In this example, the surface mark 16 shown in FIG. 3 has been wiped from the wall or surface 3.

In an example, the surface mark 16 is a readily removable material, such as chalk, dust, or graphite. Other materials may also be suitable. As such, the surface mark 16 that was left on the wall can be removed from the surface 3 by rubbing with an implement such as a cloth, eraser, human hand, or human finger.

In another example, the surface mark 16 may be more difficult to remove (as with colored pencil, erasable ink, washable ink, or watercolor paint), and may be removed with an implement such as a washcloth or sponge wetted with water or some other solvent that is unlikely to damage the surface 3.

In another example, the surface mark 16 may be indelible (as with permanent ink or paint), such that it cannot readily be removed except through the application of strong solvents that carry a risk of damaging the wall or surface.

In still other examples, the surface mark 16 may be visible under alternative light sources such as UV, infrared, laser, or monochromatic LED light, while being substantially invisible under ordinary ambient natural or artificial light.

FIG. 6 shows an example process of placing an example in-situ surface marker 10 on an example surface hanging 2. In this example, the attachment hardware 1 is a wire. When the wire is stretched to its full extent by hand or with a tool, the center point of the wire is marked, and an in-situ surface marker 10 is placed at the location of the center point of the wire. At this point, the surface hanging 2 can be pressed against the wall or surface 3 to leave a surface mark 16 into which a fastener 4 may be driven.

In another example, one can mark the center of the surface hanging 2 with one in-situ surface marker (e.g., one that produces a small circular spot), then measure the applicable number of inches down on the wall to attach the fastener.

FIG. 7 shows an example surface hanging 2 (e.g., a framed picture) being hung on the wall having used the preparatory techniques described herein. In this example, the surface hanging 2 has been hung by resting or attaching the attachment hardware 1 shown in FIG. 2, to the example fastener 4 shown in FIGS. 4 and 5.

In an example, the surface hanging 2 may be any of a wide variety of types and sizes, and intended to hang from any non-floor surface including but not limited to walls, ceilings, screens, dividers, cubicles, and containers. In an example, there is no lasting mark on the surface 3. However, in other examples the surface mark may remain on the wall as it is hidden from view behind the surface hanging 2. It may even be desired for the surface mark 16 to be durable or even permanent.

FIG. 8 shows another example of in-situ surface markers 10 with corresponding example attachment hardware 1. In this example, the attachment hardware 1 is a keyhole fastener with a single hanger location marked by a pattern of marking material 15 of roughly comparable size to indicate where the nail or screw serving as the hanger is to be located on the wall.

Figure 9:
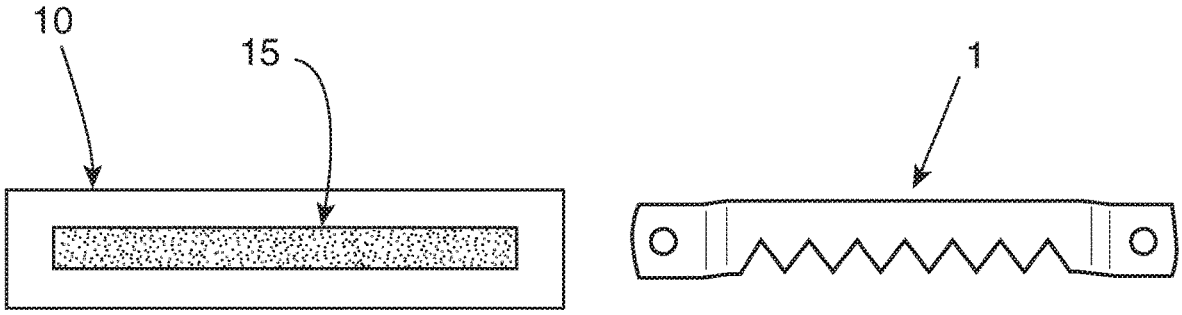
FIG. 9 shows another example in-situ surface marker with corresponding example attachment hardware.

FIG. 9 shows another example in-situ surface marker 10 with corresponding example attachment hardware 1. In this example, the attachment hardware 1 is a sawtooth fastener, whose position is marked by a single rectangular pattern of marking material 15 of roughly comparable size.

Figure 10:
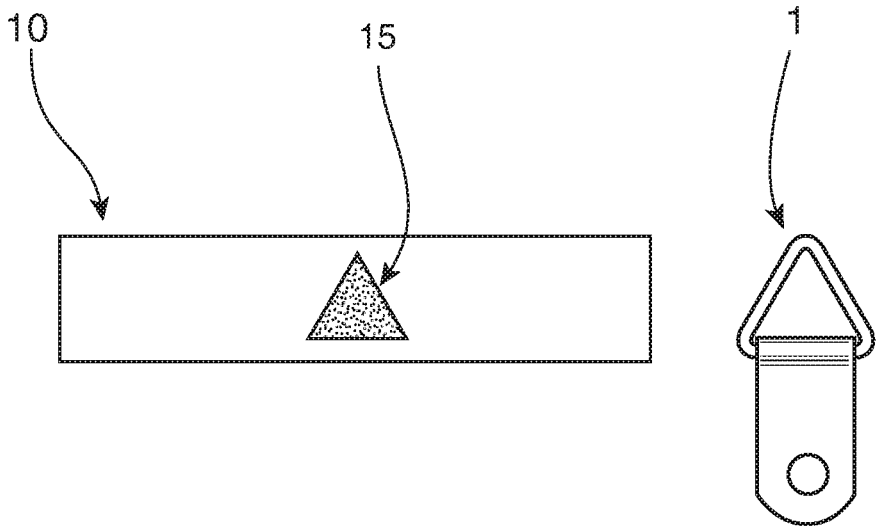
FIG. 10 shows another example in-situ surface marker with corresponding example attachment hardware.

FIG. 10 shows another example in-situ surface marker 10 with corresponding example attachment hardware 1. In this example, the attachment hardware 1 is a D-ring hanger, whose position is marked by a single triangular pattern of marking material 15 of roughly comparable size.

The components and operations shown and described herein are provided to illustrate example implementations. It is noted that the components, arrangements, and operations are not limited to the ordering shown. For example, the in-situ surface marker could be incorporated directly into the surface hanging and its hardware at the time of manufacture. Alternatively, instead of being a strip of material the in-situ surface marker could be a square, rectangle circle, or any other shape that served the intended purpose as described above. Furthermore, instead of being flexible and conformable, the in-situ surface marker could be a rigid component such as a cap that fit over the attachment hardware or a small sphere, rod or other form that lodged temporarily inside or alongside the attachment hardware or in the expected position of the attachment hardware so as to serve the intended purpose as described above.

It is noted that the examples shown and described are provided for purposes of illustration and are not intended to be limiting. Still other components, arrangements, and operations may also be implemented.

The invention claimed is:

1. A method of marking a surface with an intended location of a fastener for a surface hanging, comprising:

providing an in-situ surface marker having a base having a first side with an adhesive and second side with a marking material;

adhering the base to the surface hanging when the in-situ surface marker is positioned on the surface hanging with an adhesive side of the base that is not removable from the surface hanging; and marking a position on a wall or other surface when the surface hanging is positioned against the wall or other surface in a desired position and orientation, such that the marking leaves a corresponding surface marking on the wall or other surface.

2. The method of claim 1, wherein adhering the base to the surface hanging is at least partly over attachment hardware of the surface hanging to mark a position of the attachment hardware on the wall or other surface.

3. The method of claim 1, wherein adhering the base to the surface hanging is adjacent attachment hardware of the surface hanging to mark a position of the attachment hardware on the wall or other surface.

4. An in-situ surface marker, comprising:

a base;

an adhesive side of the base having an adhesive thereon to attach the base to a surface hanging, wherein the adhesive side of the base is not removable from the surface hanging;

a marking side of the base having a marking material configured to at least partially transfer from the base to a wall or other surface when the surface hanging is pressed against the wall other surface, thereby marking the wall or other surface indicating a position behind the surface hanging that is not visible when the surface hanging is against the wall or other surface.

5. The device of claim 4, wherein the marking material is removable from the wall or other surface.

6. The device of claim 4, wherein the marking material is durable and not removable from the wall or other surface.

7. The device of claim 4, wherein the marking material is visible to the naked eye under ambient lighting conditions.

8. The device of claim 4, wherein the marking material is only visible under alternative light sources.

9. The device of claim 4, wherein the marking material is configured on the base to correspond to attachment hardware of the surface hanging.

10. The device of claim 9, wherein the marking material is configured on the base to correspond by size of the attachment hardware of the surface hanging.

11. The device of claim 9, wherein the marking material is configured on the base to correspond by shape of the attachment hardware of the surface hanging.

12. The device of claim 9, wherein the marking material is configured on the base to correspond by number of fasteners for the attachment hardware of the surface hanging.

13. The device of claim 4, wherein the base is configured for attachment over attachment hardware of the surface hanging.

14. The device of claim 4, wherein the base is configured for attachment adjacent attachment hardware of the surface hanging.

15. The device of claim 4, wherein the base is configured for attachment at a tension point of a wire on the surface hanging.

16. The device of claim 4, wherein the adhesive side of the base is removable from the surface hanging.

17. The device of claim 4, wherein base is flexible.

18. The device of claim 4, wherein base is rigid.

19. A device for marking the position of a fastener to be provided on a wall or other surface for attaching a surface hanging, comprising:

a base;

an adhesive side of the base having an adhesive thereon to attach the base to the surface hanging, wherein the adhesive side of the base is not removable from the surface hanging;

a marking side of the base having a marking material configured to at least partially transfer from the base to the wall or other surface when the surface hanging is pressed against the wall other surface; thereby leaving a mark on the wall or other surface that is behind the surface hanging and thus not visible when the surface hanging is against the wall or other surface.

* * * * *